United States Patent [19]

Samuelson

[11] Patent Number: 4,602,982

[45] Date of Patent: Jul. 29, 1986

[54] PROCESS FOR DELIGNIFYING BLEACHING LIGNIN-CONTAINING CELLULOSE PULP BY ACTIVATING THE PULP WITH $NO_2$ AND $O_2$ GAS IN THE PRESENCE OF WATER, SODIUM NITRATE AND NITRIC ACID

[75] Inventor: Hans O. Samuelson, Gothenburg, Sweden

[73] Assignee: Mo och Domsjo Aktiebolag, Ornskoldsvik, Sweden

[21] Appl. No.: 556,498

[22] Filed: Nov. 30, 1983

[30] Foreign Application Priority Data

Dec. 1, 1982 [SE] Sweden ..... 8206859

[51] Int. Cl.[4] ..... D21C 1/04; D21C 3/16; D21C 9/10

[52] U.S. Cl. ..... 162/40; 162/65; 162/81

[58] Field of Search ..... 162/19, 65, 81, 90, 162/60, 63

[56] References Cited

U.S. PATENT DOCUMENTS

| | | | |
|---|---|---|---|
| 1,040,198 | 1/1932 | Heimann et al. | 162/81 |
| 1,829,852 | 11/1931 | Darling | 162/81 |
| 1,923,292 | 8/1933 | Bassett | 162/81 |
| 4,076,579 | 2/1978 | Brink | 162/81 |

FOREIGN PATENT DOCUMENTS

| | | | |
|---|---|---|---|
| 2483972 | 12/1981 | France | 162/81 |
| 2496138 | 6/1982 | France | 162/81 |

*Primary Examiner*—Steve Alvo

[57] ABSTRACT

A process is provided for delignifying bleaching lignin-containing cellulose pulp which comprises:

(1) activating cellulose pulp by reacting the pulp at a pulp consistency within the range from about 20% to about 60% and at a temperature within the range from about 20° to about 130° C. with a gas comprising $NO_2$ and oxygen in the presence of water, sodium nitrate in an amount of at least 0.15 g mole per kg of water, and optionally nitric acid;

(2) washing the activated pulp with water or an aqueous solution; and (3) treating the activated washed pulp with an aqueous alkaline solution at a temperature within the range from about 70° to about 170° C., optionally in the presence of oxygen gas until the lignin content of the pulp is so reduced that the Kappa number of the pulp is within the range from about 10 to about 60% of the Kappa number of the pulp entering the activating stage (1).

16 Claims, 1 Drawing Figure

PROCESS FOR DELIGNIFYING BLEACHING LIGNIN-CONTAINING CELLULOSE PULP BY ACTIVATING THE PULP WITH $NO_2$ AND $O_2$ GAS IN THE PRESENCE OF WATER, SODIUM NITRATE AND NITRIC ACID

It is well known that chlorine-containing bleaching agents give rise to chlorinated aromatic substances. The major part can not be destroyed by biological purification of the sewage water. Some chlorinated compounds discharged with spent bleach liquor are bioaccumulatable and taken up by fish. Some chlorinated products have been found to be mutagens.

Consequently, disposal of chlorine-containing waste bleaching liquor from bleaching plants constitutes a very serious problem. Efforts have been made to reduce the use of free or elementary chlorine in the bleaching of cellulose pulp by use of chlorine dioxide instead. The production of chlorine dioxide requires about three times as much electrical energy per kilogram of active chlorine as elementary chlorine.

Nitrogen dioxide has been proposed as a substitute for chlorine in the bleaching delignification of cellulose pulp, and has been studied by Clarke (*Paper Trade Journal, Tappi. Sect.* 118 62 (1944)). Clarke has found that cellulose pulp can be partially delignified by treating the pulp in an aqueous suspension for from 1 to 1.5 hours at 90° C. with nitrogen dioxide, followed by extraction at 90° C. for 30 minutes, or at 50° C. for 60 minutes at a 7% pulp consistency and an alkali charge corresponding to 2% NaOH, calculated on the dry weight of the pulp. The treatment results in a severe depolymerization of the cellulose, which is reflected in a very low viscosity of the treated pulp, compared with pulp subjected to chlorination and alkali extraction.

Bourit (French patent specification No. 2,158,873) avoids depolymerization by applying a delignification process in which the pulp is treated with nitrogen dioxide at low temperature, preferably a temperature below 20° C., and for a long period of time, followed by an alkali extraction under mild conditions. The cellulose pulp is only delignified to a very small extent, however, and the method does not afford any solution to existing environmental problems.

The delignification of lignocellulosic material by treatment with nitrogen dioxide, followed by washing with water, treatment with alkali, and subsequent treatment with oxygen gas, has also been proposed in Swedish patent application No. 77 05136-5. However, this technique has not been put into commercial practice, because although enabling a high degree of delignification, the method causes a drastic lowering of the viscosity.

Another proposal which has not come into practice has been made in Swedish patent application No. 75 06646-4. This bleaching process includes the steps of (1) treating the cellulosic material with a blend of nitrogen monoxide and nitrogen dioxide with nitrogen monoxide in a molar excess, (2) washing with water, and (3) then treating with alkali, for example, in the presence of oxygen gas, under superatmospheric pressure. The nitrogen dioxide can optionally be generated in situ from nitrogen monoxide and oxygen, in which case the nitrogen monoxide is added in an excess of four times the added molar amount of oxygen. The reaction proceeds under superatmospheric pressure with respect to nitrogen monoxide; for example 7 kp/cm$^2$ is shown in Example 1. The nitrogen oxides are removed by depressurizing, followed by evacuation. In every Example, a superatmospheric pressure is employed in the handling of the nitrogen oxides. The handling problems remain, with a great risk of injury to both the internal and external surroundings, and a high consumption of nitrogen oxides. This method also results in a considerable lowering of the viscosity, although it does enable a high degree of delignification to be obtained.

When the pretreatment with nitrogen oxide is followed by an oxygen gas bleaching stage, it is said to suitable, subsequent to displacing or washing from the pulp pulping liquor derived from a pulping process with the use of waste liquor derived from the oxygen gas bleaching, to wash the pulp with the acid washing liquid obtained in the washing stage after the pretreatment. When the acid washing liquid is not washed from the pulp before treating the pulp with nitrogen dioxide, the pH of the liquid is reported to 2.0, which corresponds to about 0.01 gmole nitric acid, calculated per kg of water in the pulp. The prime object of the method is to remove harmful metal compounds from the pulp.

In summary, the pretreatment of cellulose pulp with nitrogen dioxide $NO_2$ before an oxygen gas bleaching makes possible a more complete delignification an improved oxygen gas bleaching, without deterioration in the paper-making properties of the pulp. However, relatively large quantities of nitrogen oxides and starting material (ammonia) for the manufacture of said oxides, respectively, are consumed in the process.

Brink U.S. Pat. No. 4,076,579, patented Feb. 28, 1978, delignifies particulate lignocellulosic material by nitric acid, which is formed in situ by first treating the lignocellulosic material with nitric oxide, and then reacting the nitric oxide with molecular oxygen. Brink intends to provide a higher-yield pulping process than current commerical alkaline pulping processes, one which can be conducted in an initial reaction at atmospheric pressure and relatively low temperature.

The pulping process is described in detail beginning at column 3, line 20.

While Brink is concerned with a delignification requiring nitric acid, in contrast to an activation involving nitrogen dioxide and oxygen gas, Brink does form nitric acid in situ from nitrogen oxides that can react with moisture to form nitric acid, and preferably most advantageously, from nitric oxide NO, although nitrogen tetroxide ($N_2O_4$), nitrogen trioxide ($N_2O_3$), nitrogen dioxide ($NO_2$) and nitrate ions, nitric ions, nitronium ions, and nitrosonium ions are also suggested.

Nowhere however does Brink suggest a reaction with nitrogen dioxide, $NO_2$, and oxygen.

There is no teaching of a reaction between wood (or pulp) and $NO_2/O_2$; there is only a teaching of a reaction between wood (or pulp) and $HNO_3$.

When applied to lignocellulosic material, the Brink process involves a completely different set of reactions from an activation, applied to pulp. Brink's reactions with nitric acid also can involve different constituents of the lignocellulosic material (or pulp).

In addition to application to lignocellulosic material, under time and temperature conditions which represent pulping conditions, as a first stage, Brink also applies the process as a second stage, in treating the pulp product resulting from the first stage, using a lower temperature, and a higher moisture content of the lignocellulosic material; the reaction time is the same. Nonetheless, Brink does not disclose reaction of pulp with $NO_2$ and $O_2$. Neither does Brink disclose a combined activation by $NO_2$—$O_2$ followed by oxygen gas bleaching.

In accordance with Samuelson, U.S. Ser. No. 270,438, filed June 4, 1981, now U.S. Pat. No. 4,439,271, patented Mar. 27, 1984, the activation stage is carried out with nitrogen dioxide gas in the presence of oxygen gas in an amount such that nitrogen monoxide formed as an intermediate is consumed, while regulating the amount of oxygen gas that is added in such a manner that at the conclusion of the activation stage practically all of the nitrogen monoxide and nitrogen dioxide have been consumed.

That invention accordingly provides a process for the treatment of cellulose pulp with nitrogen dioxide $NO_2$ adapted for application before an oxygen gas bleaching to make possible a more complete delignification and an improved oxygen gas bleaching, without deterioration in the paper-making properties of the pulp, which comprises subjecting the cellulose pulp to an activation reaction with nitrogen dioxide gas in the presence of water and pure oxygen gas in an amount within the range from about 0.1 to about 5 moles per mole of $NO_2$ and in an amount within the range from about 0.6 to about 5 moles per mole of NO, so that nitrogen monoxide formed in the activation is utilized in the activation reaction.

That invention also provides a process for the delignification of cellulose pulp, including chemical pulp prepared from the digestion of lignocellulosic material, which comprises bringing the cellulose pulp in an activation stage in the presence of water and in contact with a gas phase containing nitrogen dioxide and modifying the lignin of the cellulose pulp by reaction with nitrogen dioxide; adding oxygen gas to the activating reaction in an amount within the range from about 0.1 to about 5 moles per mole of $NO_2$ and in an amount within the range from about 0.6 to about 5 moles per mole of NO, so that nitrogen monoxide formed in the activation is utilized in the activation reaction; and then in a second stage, subjecting the pulp to an oxygen gas bleaching in the presence of an alkaline-reacting neutralization medium or neutralizing agent.

In accordance with Samuelson, U.S. Ser. No. 330,406, filed Dec. 14, 1981, cellulose pulp produced by chemically pulping lignocellulosic material is contacted in an activating stage in the presence of water with a gas phase containing $NO_2$ and oxygen gas in excess. Thereafter, the pulp is subject to an alkali treatment, both the activating stage and the alkali treatment stage being carried out under drastic conditions, at such high temperature during the activating stage as to obtain a certain degree of degradation of the cellulose molecules, and at a temperature during the alkali treatment process within the range from about 95° to about 150° C., suitably from 101° to 140° C., preferably from 110° to 120° C., the treatment time at 95° C. exceeding 45 minutes, at 101° C. exceeding 30 minutes, and at 110° C. exceeding 15 minutes.

The change in the intrinsic viscosity of the cellulose pulp during the pretreatment is used as a measurement of the extent to which the cellulose molecules have been degraded. The viscosity values given therein have all been determined without removing lignin and hemicellulose, which is the most reproducible method for pulps with a moderate lignin content (for example with sulfate pulps having a Kappa number below 35).

This process has however the disadvantage that it requires a very high alkali charge, and results in a high loss of carbohydrates, if the two-stage process is carried far enough to achieve a low lignin content.

In accordance with Samuelson, U.S. Ser. No. 358,998 filed Mar. 17, 1982, residual lignin in cellulose pulp produced by chemically pulping lignocellulosic material is removed while maintaining good pulp quality by contacting the cellulose pulp in an activating stage in the presence of water with a gas phase containing $NO_2$ and oxygen gas at a temperature within the range from about 40° to about 100° C. sufficient to obtain a degradation of the cellulose molecules resulting in a reduction in the intrinsic viscosity of the cellulose pulp during the activation stage within the range from about 2 to about 35% compared to the intrinsic viscosity prior to the activation; and then subjecting the pulp to an oxygen gas-alkali-treatment at a temperature within the range from about 80° to about 150° C., at an oxygen partial pressure within the range from about 0.005 to about 0.18 MPa.

A partial pressure of 0.18 MPa with respect to oxygen gas during a major part of the oxygen gas-alkali-treatment affords rapid delignification and good selectivity, while delignification at 0.005 MPa takes place very slowly. At a partial pressure below 0.005 MPa, the bleaching is reduced, and the brightness of the pulp is impaired. The pulp acquires a greyish color, but pulp treated at a higher oxygen gas pressure becomes a pure yellow color. In addition, the pulp yield decreases at low oxygen pressure.

In accordance with Samuelson Ser. No. 361,289, filed Mar. 24, 1982, a process is provided for activating chemical cellulose pulp and then delignifying bleaching the activated pulp, which comprises treating chemical cellulose pulp in an activating stage with nitrogen oxides in the form of $NO_2$and/or NO and/or polymer forms and double-molecules thereof, such as $N_2O_4$ and $N_2O_3$ and with an oxygen-containing gas in the presence of nitric acid added in an amount within the range from about 0.1 to about 1.0, suitably from 0.15 to 0.80, preferably from 0.25 to 0.60, g mole per kg of water accompanying the cellulose pulp at a temperature within the range from about 40° to about 120° C., suitably from 50° to 100° C., preferably from 55° to 90° C. for an activating time at an activating temperature of from 40° to 50° C. offrom about 15 to about 180 minutes, at a temperature of from 50° to 90° C. of from about 5 to about 120 minutes, and at temperatures above 90° C. from 1 to about 10 minutes, followed by a washing and at least one delignifying stage in an aqueous alkaline medium, either in the presence or in the absence of oxygen gas and/or peroxide.

The combination of these nitrogen oxides and nitric acid provides an activating effect which results in a greatly improved delignification after the alkaline delignifying stage. The delignifying effect obtained in accordance with the invention with 2% $NO_2$ by weight of the dry pulp is approximately the same as that obtained with twice the amount of $NO_2$, if no nitric acid is added. This is surprising, since treatment of the pulp with nitric acid in a concentration within the stated range prior to the alkaline stage, without any addition of $NO_2$ and/or NO, has no appreciable effect on the delignification. The activation gives rise to an improved delignification irrespective of whether or not oxygen or peroxide is present in the alkaline delignifying stage.

It is surprising that when a suitable amount of nitric acid is present during the activating stage, depolymerization of the carbohydrates, primarily in cellulose, is slowed down in the alkaline delignifying stage when the alkaline medium constitutes an oxygen gas delignifying medium. Thus, under optimum conditions while there is a certain depolymerization (loss in viscosity) in the activating stage, a pulp is nonetheless obtained whose viscosity after the alkaline oxygen gas delignifying stage, not only when compared at the same lignin content (Kappa number) of the pulp but also when compared at the same reaction time in the oxygen gas stage, is markedly higher than that of pulp similarly activated, but without nitric acid being added during the activating stage. Obviously when a proper amount of nitric acid is present, the activation provides a chemical reaction which greatly inhibits the degradation of cellulose in the subsequent alkaline oxygen gas bleaching stage.

Two-stage methods comprising pretreatment of pulp with nitrogen dioxide followed by oxygen gas bleaching with sodium hydroxide as the active alkali enable extensive delignification to be carried out, but chemical consumption, however, is high, and it is difficult to obtain simultaneously extensive delignification, paper of good strength properties from the pulp, and a high carbohydrate yield, without incurring high costs.

Rising energy prices and environmental care have made necessary the replacing of present energy-consuming and environmentally-harmful chemical-pulp bleaching processes with a process which consumes less energy and which, in addition, enables all, or at least a major part, of the waste liquors deriving from the bleaching plant to be burned in conventional waste-liquor combustion processes. The oxygen gas bleaching of pulp directly after digestion, using sodium hydroxide as the active alkali, is a process now used in many sulphate plants. The process affords a reduction in the amount of chlorine and sodium hydroxide used in the bleaching stages, and enables release and combustion of about half of the total amount of dry solids released in the bleaching stages. When the oxygen gas bleaching process is more extensive, the carbohydrates are excessively depolymerized, resulting in a pulp having poorer paper qualities. An important recognized problem is how to effect more extensive delignification using smaller amounts of chlorine, sodium hydroxide and oxygen gas, while burning a larger percentage of the waste by products.

In accordance with the invention of Ser. No. 449,889, filed Dec. 16, 1982, now U.S. Pat. No. 4,445,969, patented May 6, 1984, a process is provided for delignifying bleaching lignin-containing cellulose pulp in three stages, an activating stage, in which there is supplied to the water-containing pulp NO and/or $NO_2$ and $O_2$, and optionally $HNO_3$; a first alkaline stage, in which alkali is supplied as carbonate, primarily $HCO_3^-$, with oxygen gas; and a second alkaline stage in which alkali is supplied as carbonate, primarily $CO_3^=$, with oxygen gas.

The process comprises:

(1) activating cellulose pulp by reacting the pulp with a gas comprising $NO_2$ and oxygen in the presence of water and optionally nitric acid;

(2) washing the activated pulp with water or an aqueous solution;

(3) treating the activated washed pulp with an aqueous alkaline solution comprising an alkaline carbonate of which a major proportion is in the form of bicarbonate $HCO_3^-$ at a temperature within the range from about 90° to about 170° C., suitably from about 105° to about 160° C., preferably from about 115° to about 140° C., in the presence of oxygen gas at an average oxygen partial pressure within the range from 0.001 to about 0.2 MPa, until the lignin content of the pulp is so reduced that the Kappa number of the pulp is within the range from about 10 to about 60%, suitably within the range from about 20 to about 50%, preferably within the range from about 25 to about 40% of the Kappa number of the pulp entering the activating stage (1), and releasing carbon dioxide gas liberated;

(4) treating the activated washed pulp with an aqueous alkaline solution comprising an alkaline carbonate of which a major proportion is in the form of carbonate $CO_3^=$ at a temperature within the range from about 90° to about 170° C., suitably within range from about 110° to about 150° C., preferably within the range from about 120° to about 140° C., in the presence of oxygen gas at an average oxygen partial pressure within the range from about 0.1 to about 3 MPa; suitably within the range from about 0.2 to about 1.8 MPa, preferably within the range from about 0.3 to about 1.0 MPa;

(5) withdrawing from stage (4) alkaline liquor comprising $HCO_3^-$ and recycling said liquor to stage (3) as a source of $HCO_3^-$.

Figure 1:
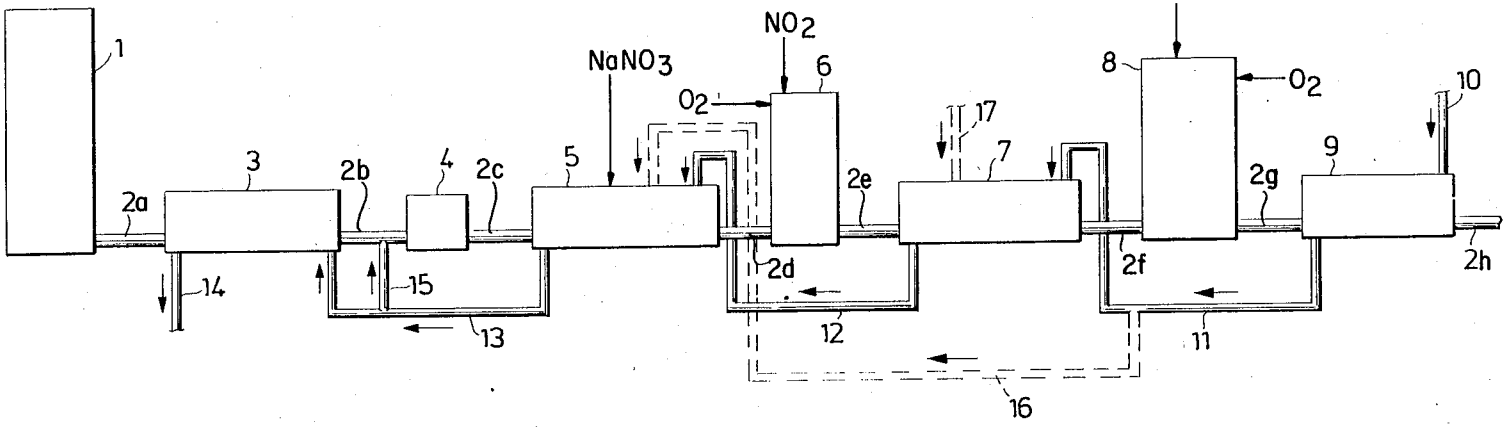
FIG. 1 illustrates a preferred embodiment of the method of invention.

The process is applicable to any chemical cellulose pulp, but especially chemical cellulose pulp prepared using an alkaline pulping liquor. Examples of alkaline chemical pulps include sulfate pulp, polysulfide pulp and soda pulp. In the soda pulp group are included pulps digested with sodium hydroxide as well as other alkaline materials, in the presence of the usual additives. Examples of additives include redox catalysts, such as anthraquinone. The process is also applicable to other chemical pulps, such as, for example, sulfite pipe.

A difficulty found in introductory activation stages using NO and/or $NO_2$ together with oxygen gas in the treatment of cellulose pulp, followed by a delignifying stage, is that relatively large quantities of nitrogen oxides are consumed. Because nitrogen oxides, for example, $NO_2$ ($N_2O_4$), are expensive chemicals, the transportation and handling of which require strict safety measures to be observed, it is desirable to reduce as much as possible the amount of nitrogen oxides which needs to be charged to each activation process.

In accordance with the present invention, it has been determined that in a two-stage process comprising an activation stage with $NO_2/O_2$ followed by an alkaline delignification stage, the addition of sodium nitrate in the activation stage results in a greatly improved delignification after the alkaline delignification stage, when compared with the same quantity of nitrogen oxides consumed. This is quite remarkable, since dilute solutions of sodium nitrate are particularly stable at the temperature range in question, and at temperatures far above this range, and since sodium nitrate in solution is normally considered an inert salt. Indeed, during a treatment without any addition of nitrogen oxide, sodium nitrate will not provide any activation effect. The effect obtained with mixtures of nitric acid and sodium nitrate in the presence of oxygen under comparable conditions is also negligible, if no nitrogen oxides are added.

Moreover, when the alkaline delignification stage is an oxygen-gas bleaching stage, depolymerization of the carbohydrates, primarily the cellulose, is greatly retarded in this stage, if a suitable amount of sodium nitrate is present during the activation stage. This protective effect is especially outstanding when in addition to sodium nitrate, nitric acid is also present during the activation stage. Despite a certain degree of depolymerisation (viscosity loss) in the activation stage, in this case there is obtained a pulp having an appreciably higher viscosity after the alkaline oxygen-gas delignification stage than a pulp compared at the same lignin content (Kappa number) which has been treated with $NO_2/O_2$ in an activation stage in the absence of sodium nitrate. Apparently, the activation results in some other chemical reaction, in addition to improved lignin dissolution, which strongly retards the degradation of cellulose in the subsequent alkaline oxygen-gas bleaching delignification stage.

An important advantage is that the chemical costs for the activation process are drastically reduced, in comparison with previously known techniques. This saving in chemical costs is manifested in many different ways, depending upon whether nitrogen dioxide is purchased or produced in the pulp mill from ammonia.

When pulps are compared at the same pulp viscosity and lignin content after the alkaline delignification stage, the process of the invention enables the charge of nitrogen oxides to be decreased to about 25% of that needed in the conventional activation in which the pulp is impregnated with water, and nitrogen oxides and oxygen gas then supplied. The sodium nitrate (and, in the most preferred embodiment, also nitric acid) added can be recovered at the conclusion of the process, after either the activation stage or the alkaline delignification stage or both, and recycled, since nitric acid is generated in the activation stage and sodium ions can be present in the alkali charged to the alkaline delignification stage. Normally, sodium is recovered by combusting spent liquor obtained from the process.

The process according to the invention makes it possible to remove 80% or more of the amount of lignin remaining in the pulp after the cook, while maintaining good pulp properties, and extremely low chemical costs.

The process of delignifying bleaching lignin-containing cellulose pulp in accordance with the present invention comprises:

(1) activating cellulose pulp by reacting the pulp at a pulp consistency within the range from about 20% to about 60% and at a temperature within the range from about 20° to about 130° C. with a gas comprising $NO_2$ and oxygen in the presence of water, sodium nitrate in an amount of at least 0.15 g mole per kg of water, and optionally nitric acid;

(2) washing the activated pulp with water or an aqueous solution; and (3) treating the activated washed pulp with an aqueous alkaline solution at a temperature within the range from about 70° to about 170° C., optionally in the presence of oxygen gas until the lignin content of the pulp is so reduced that the Kappa number of the pulp is within the range from about 10 to about 60% of the Kappa number of the pulp entering the activating stage (1).

The first stage of the two-stage process of the invention has been referred to as an activation stage. This is correct insofar as the two-stage process normally leads to a quick delignification in the following oxygen gas bleaching stage. It can however be said that the term "deactivation" is more relevant, under certain conditions. Under these conditions, the strongest effect is that the pulp behaves as though it were deactivated, in such a manner that the degradation of the carbohydrates during oxygen gas bleaching, which is a kind of cellulose depolymerization, becomes much slower than normally. Probably the dominating effect is indirect, and does not occur from reactions between nitrogen dioxide and/or nitrogen monoxide and the carbohydrates.

The process of the invention is applicable to any cellulose pulp, but especially chemical cellulose pulp prepared using an alkaline pulping liquor. Examples of alkaline chemical pulps include sulfate pulp, polysulfide pulp and soda pulp. In the soda pulp group are included pulps digested with sodium hydroxide as well as other alkaline materials, in the presence of the usual additives. Examples of additives include redox catalysts, such as anthraquinone. The process is also applicable to other chemical pulps, such as, for example, sulfite pulp.

A high pulp concentration during the activation stage, for example, from 20 to 50%, or higher, for example 60%, makes possible a uniform reaction in a simple apparatus, in which the wet pulp is brought into contact with the gas phase. The pulp should not be added in dry form. A pulp concentration below 20% can nevertheless be used, and one can in this case find it easier to handle the pulp before the activation stage.

Known apparatus for oxygen gas bleaching with pulp of comparable consistency can be used in the activation stage. In this case, the gas addition suitably can be partly at the beginning of the process and partly after the reactions have proceeded to a suitable stage.

Normally, unbleached pulp is activated without previously drying the pulp since water is present during the activation. The pulp consistency should be within the range from about 20 to about 60%, preferably from about 25 to about 58%. Pulp which has previously been bleached and/or subjected to some other form of treatment, for example with alkali, can also be delignified by the process of the invention. The pulp can also be subjected to the process in accordance with the invention several times, for example, twice.

Nitrogen dioxide can be added in the deactivation stage in the form of substantially pure $NO_2$, or formed in situ by adding nitric oxide and oxygen. $NO_2$ plus NO can also be added. The nitrogen dioxide ($NO_2$) can be in the form of dinitrogen tetroxide ($N_2O_4$), and other polymeric nitrogen oxide forms. One mole of dinitrogen tetroxide is calculated as two moles of nitrogen dioxide. Adducts in which nitric oxide is present are calculated in the same way as nitric oxide. Thus, dinitrogen trioxide ($N_2O_3$) is calculated as one mole nitric oxide and one mole nitrogen dioxide. Adducts containing oxygen are probably present as intermediates.

The amounts of nitrogen oxides added are selected according to the lignin content of the pulp, the desired extent of delignification, and the extent to which an attack on the carbohydrates can be tolerated. When calculated as monomers, these amounts are normally within the range from about 0.1 to about 2, suitably from about 0.2 to about 1, preferably from about 0.3 to about 0.8 kilomoles per 100 kg of lignin in the pulp entering the activation stage.

Oxygen gas must be added to the activation stage, both when adding nitrogen dioxide ($NO_2$) and when adding nitric oxide (NO). An oxygen-containing gas can be added such as air. However, in order to obtain optimum results with the simplest apparatus, oxygen is preferably supplied to the activation stage in the form of substantially pure oxygen gas. Liquid oxygen can also be charged and gasified, for example, when entering the reactor in which the activation stage is carried out.

When using substantially pure oxygen, less $NO+NO_2$ is present in the gas phase than when using air. This also means that less inert gas needs to be removed from the stage leaving a lesser volume of gas to be treated to render the residual gases harmless.

The amount of oxygen added to the activation stage is selected according to the amount of nitrogen oxide added, so that the amount is at least 0.08, suitably within the range from about 0.1 to about 2, preferably from about 0.15 to about 0.3 mole per mole of $NO_2$. Investigation has shown that the most preferable charge lies within the range from about 0.25 to about 0.8 mole $O_2$ per mole of $NO_2$.

If NO or a mixture of NO and $NO_2$ is used, oxygen gas is added in an amount of at least 0.58, suitably within the range from about 0.60 to about 3.0, preferably from about 0.65 to about 0.85 mole per mole of NO added. The most preferable amount is within the range from about 0.75 to about 1.3 mole per mole of NO added.

When nitric oxide is used, it is added in increments or continuously and the oxygen is added in increments or continuously prior to the termination of the nitric oxide addition. In this way, activation is smoother than when oxygen gas is not charged until all the nitric oxide has been added. The reactor can be designed for batchwise operation or for continuous operation with continuous in-feed of the cellulose pulp at one end, and continuous out-feed of the cellulose pulp at the other end, and the supply of gases thereto.

The sodium nitrate is suitably added in the form of an aqueous solution. According to a preferred embodiment of the invention, the sodium nitrate is added to the activation stage before the nitrogen oxides. When no nitric acid is added the amount of sodium nitrate added is calculated as the total quantity of nitrate determined analytically.

The sodium nitrate solution should not be alkaline, and consequently any alkali that may be present is neutralized by adding an acid prior to adding the sodium nitrate solution to the cellulose pulp. The neutralization of the sodium nitrate solution must be carried out before the introduction of the nitrogen oxides.

Within those limits which may be applicable with respect to the solubility of the sodium nitrate and to the economy of the process, an improved delignification is obtained with an increasing molarity with respect to sodium nitrate. An addition of sodium nitrate less than 0.15 g mole per kg of water accompanying the cellulose pulp does not produce any effect which is useful in practice. A suitable concentration is 0.25 g mole per kg of water, particularly if the treatment temperature is higher than 50° C. Normally, there is preferably used a concentration of at least 0.3 g mole per kg of water. Further improvement is obtained with a concentration of at least 0.6 g mole per kg of water.

Normally, when the pulp in the activation stage has a concentration of 40% or less, delignification is improved with an increasing temperature and increasing residence time in the activation stage. Exceptions to this rule have been observed in the case of extremely high pulp concentrations.

The temperature in the activation stage is normally less than that at which appreciable depolymerisation of the cellulose occurs, which is reflected in a lowered intrinsic viscosity. The lowering of the intrinsic viscosity in the activation stage should be no more than 35%, preferably no more than 25%, when producing pulps intended for use in the manufacture of high-strength papers. Normally, the reduction in the intrinsic viscosity should be no greater than from 2 to 35%, and preferably from 5 to 15%.

The temperature in the activation stage normally lies within the range from about 20° to about 130° C., suitably from about 40° to about 110° C., preferably from about 50° to about 100° C., for an activation time within the range from about 15 minutes to about 4 hours at from 20° to about 40° C., and is suitably shortened at higher temperatures, so as to hold depolymerisation of the cellulose within these limits.

These temperature limits also apply when nitric acid is added, and preferably when the amount of nitric acid added is less than 0.05 g mole per kg of water accompanying the cellulose pulp. In the preferred embodiment, in which the nitric acid added provides a concentration above this limit, the temperature is lowered, so as to avoid an excessive drop in viscosity in the activation stage. The viscosity of the cellulose pulp after the activating stage should be checked as a matter of routine, and the conditions, for example, the temperature in said stage, adapted in accordance with the values obtained.

Superior results are obtained, especially with respect to selectivity at low lignin contents (low Kappa numbers), when, in addition to sodium nitrate, nitric acid is also added to the cellulose pulp in the activation stage. Selectivity is the viscosity at a given Kappa number. Sodium nitrate and nitric acid can be supplied together in the same aqueous solution which is preferred. The nitric acid and sodium nitrate can be added in separate aqueous solutions.

The amount of nitric acid added should be within the range from about 0.05 to about 1.2, suitably from about 0.10 to about 1, preferably from about 0.2 to about 0.8 g mole per kg of water accompanying the cellulose pulp.

When no other mineral acids are supplied to the activation stage, the total nitrate concentration is, for example, 0.45 g mole per kg of water, and the hydrogen ion concentration is 0.2 g mole per kg water, when the sodium nitrate added is 0.25 g mole per kg water and the nitric acid added is 0.2 g mole per kg water. In addition, a certain percentage of the nitrogen oxide added, for example from 70 to 85 mole percent (calculated as monomers), is converted to nitric acid during the activation stage. Such nitric acid formed in situ is not included in the amount added.

On the other hand, included in the amounts of sodium nitrate and nitric acid added are those amounts introduced into the activation stage with re-cycling liquor, for example washing liquor obtained from washing the pulp following the activation stage and/or subsequent alkaline delignification stages or recovered from the two-stage process in any other manner.

Thus, sodium present in the sodium nitrate can be recovered from the alkaline delignification stage in whole or in part, for example by washing, pressing and/or displacement. Recycling of liquor to this stage is also suitable, so that the amount of sodium, and in relevant cases, also the amount of nitrate, is greater than would be the case if such recycling was omitted. In practice, nitrate is introduced into the activation stage by recycling nitrate recovered from the activation stage. In addition, recycling alkali in the form, for example, of NaOH, oxidized white liquor, sodium carbonate and/or sodium hydrogen carbonate reduces the total quantity of alkali added to the process.

The process according to the invention thus affords the advantage of avoiding an excess of sodium ions, in comparison with nitrate ions, in recycled liquors, for example, in liquors supplied to the cellulose pulp in conjunction with the activation stage.

It is both economically advantageous and possible in practice to recover nitrate present in the sodium nitrate, in whole or in part, from the activation stage, for example, by washing, pressing and/or displacement. In order to increase the concentration of nitrate in the solution recovered from the activation stage, which solution contains both free nitric acid and sodium nitrate, it is desirable also in said stage to recycle the spent liquor, optionally after adjusting the composition of said liquor by adding acid, alkali and/or sodium nitrate thereto.

In order to increase the hydrogen-ion concentration of the solution supplied to the cellulose pulp during the activation stage, nitric acid can be used. It is often economically advantageous to use another mineral acid, for example, sulphuric acid and/or sulphurous acid, which can be supplied to the process at a suitable stage. The acid can be introduced directly to the activation stage, or to recovered liquors, which are then brought into contact with the cellulose pulp in the activation stage, either directly, or via a washing stage, or by recycling.

When sulphurous acid is used, the acid can be mixed with alkaline waste liquors from the process. Gas which contains oxygen, for example air, can be suitably charged to the system, in order to oxidize the sulphite ions to sulphate. Gaseous $SO_2$ can also be used instead of sulphurous acid, thereby avoiding unnecessary dilution. Solutions which contain hydrochloric acid can also be charged to the system, for example, acid waste liquors obtained from the bleaching of cellulose pulp, preferably waste liquor obtained from the final bleaching of pulp produced in accordance with the invention. The amount of hydrochloric acid and other compounds containing chlorine charged to the system must be restricted according to corrosion hazards, especially in recovering and combusting the spent liquor. The amount of hydrochloric acid added is also influenced by the chloride content of the wood, and by the process in general, for example, by whether or not the liquor obtained from the activation stage accompanies, in whole or in part, the liquor which is to be combusted or whether or not this acid waste liquor is discharged to the environment, or treated in some other way.

When nitric oxide and/or nitrogen dioxide are produced from ammonia as starting material, nitric acid is formed as a by-product. This nitric acid can be used to advantage in the activation stage, preferably in combination with spent liquor recovered from the activation stage. Formation in situ of nitric oxide and nitric acid enables an extremely smooth reaction to be obtained during the activation stage, which can be readily controlled by a controlled, progressive supply of nitric oxide and oxygen, so that all of the cellulose pulp comes into effective contact with the gases, and local overheating within the reactor is avoided.

In the preferred embodiment, when the introduction of sodium nitrate and/or nitric acid is in whole or in part, in the form of process liquors, for example, liquors washed out from the pulp, and in which nitric acid is supplied in an amount within the range from about 0.05 to about 1.2 g mole per kg of water, the sodium nitrate added and the nitric acid added are calculated as follows. The amount of sodium nitrate calculated in moles is calculated as the amount of sodium in moles, a correction (decrease in the amount of sodium) being introduced for those sodium ions which are equivalent to the anions of strong acids which may be present. Examples of such anions include chloride, which may originate from the wood and possibly also from used bleaching agents containing chlorine, and hydrogen sulphate ($HSO_4^-$) and sulphate ($SO_4^=$), the last-mentioned ion corresponding to two sodium ions.

Sulphate and hydrogen sulphate can to advantage be introduced into the system in the form of sulphuric acid, in order to increase the percentage of free acid in the solution charged to the activation stage. Waste acid originating from the manufacture of chlorine dioxide, the drying of elementary chlorine, or from scrubber plants can be used. When a solution containing sulphur compounds is used in the alkaline stage, for example oxidized white liquor, this may cause, inter alia, sulphate and hydrogen sulphate to be introduced into the system.

On the other hand, the presence of carboxylate anions is totally disregarded, which is justified due to the fact that the acidity of the solution according to this embodiment is so high that the carboxylic acids can, in practice, be considered to be undissociated. Thus, this latter approximation results in the amount of nitric acid charged being defined as the total amount of nitrate determined analytically, for example, by reduction to nitrite and subsequent colorimetric determination, minus the amount of sodium nitrate.

The nitric acid can be introduced subsequent to terminating the activation with nitrogen oxides and with oxygen-containing gas and sodium nitrate, for example, so that the cellulose pulp is flushed with solution containing nitric acid from the activation stage, or a zone thereof. The acid can also be supplied to the system while treatment with these chemicals takes place. With respect to delignification, however, it has been found most advantageous to add the acid to the pulp before the nitrogen oxides are brought into contact therewith. A suitable embodiment is one in which the pulp is impregnated with an excess of a solution containing nitric acid and sodium nitrate, and the excess separated from the pulp, for example by filtering and/or pressing the pulp.

One characteristic feature of the method according to the invention resides in the fact that there is obtained with the same addition of nitrogen oxides and oxygen gas and with the same reaction parameters in general, a higher concentration of NO and $NO_2$ in the gas phase than when no sodium nitrate is present. An increase in pulp consistency and in temperature result in an increased residual gas content.

Tests have shown that the moisture content of the pulp, the temperature of the activation stage, and the amounts of nitric acid, nitrogen oxides and oxygen gas added to the system should be so selected that when half the activation time has passed, the amount of $NO+NO_2$ present in the gas phase is at least 0.08 mmole per liter of gas, measured at atmospheric pressure and at a temperature of 25° C. When manufacturing pulps with an extensive delignification, this amount should be at least 0.15, and preferably 0.2, mmole per liter.

It has been found that the major part of the nitrogen oxides charged to the system is rapidly consumed when an excess of oxygen gas is present in the activation stage, but that when sodium nitrate is present this consumption takes place very slowly towards the end of the activation stage. This is thought to be connected with the fact that nitric oxide is split off from the cellulose pulp, due to some unknown reaction. In some unknown way, this reaction is favored by the presence of sodium nitrate, and can constitute an explanation of the suprising technical effects obtained by the process according to the invention.

It has been found advantageous to lower the temperature of the cellulose pulp during a late stage of the activation, for example, when 80% of the activation time has passed. Advantageously, this lowering of the temperature is effected so that the temperature is reduced to below 40° C., and is maintained, for example, at within the range from about 10° to about 35° C., suitably from about 20° to about 30° C., and so that the residence time at a temperature below from about 40° C. is, for example, within the range from about 10 to about 120, preferably from about 15 to about 60 minutes. Cooling can be effected indirectly, for example, by cooling the gas phase, or by introducing into the system cold oxygen, for example, liquid oxygen. Evaporation of water by decreasing the pressure can also be applied for cooling.

The major part of the nitrogen oxides charged to the system in accordance with the invention give rise to nitric acid. According to a preferred embodiment of the invention, all or part of the nitric acid used in the activation stage is recovered at the end of that stage. The nitric acid is recovered in known manner, for example, by washing and/or displacement. Recovery can also be effected by pressing the pulp, preferably after dilution with water and/or an aqueous solution.

Advantageously, the nitric acid is recovered in accordance with the countercurrent flow principle, by bringing the pulp after the activation stage into contact with waste liquor obtained from said stage, with a decreased concentration with respect to nitric acid. The nitric acid recovered can be conveniently used for impregnating the pulp prior to the activation stage, the pulp being progressively brought into contact with waste liquor of increasing nitric acid concentration. This countercurrent flow-impregnation of the pulp is preferably effected subsequent to a washing or displacing from the pulp of pulping and/or washing liquor originating from the digestion of the lignocellulosic material.

In accordance with a preferred embodiment, the cooking liquor is washed or displaced from the pulp with spent alkaline liquor obtained from the alkaline delignification stage, this spent liquor being, in turn, substantially removed in conjunction with the impregnation of the pulp with the spent acid liquor obtained from the activation stage.

Sodium nitrate, and when applicable, nitric acid, can be recovered for use in the process according to the invention in various ways. The design of apparatus used in the process is dependent upon acceptable emission levels; the cost of the various relevant chemicals; for example, sodium hydroxide and other forms of alkali; the access to nitric acid of in situ or in-plant manufacture; inexpensive sulphuric acid, for example, waste sulphuric acid; and steam costs; together with the levels of interest rates and the capital available for the purchase of, for example, liquor-recovery equipment such as washing presses.

The normal procedure is to wash the pulp with water supplied from external sources, such as process waste liquors and waste solutions from other processes or apparatus not forming part of the process according to the invention. In order to obtain the best effect when washing the pulp, the pulp can be pressed in a known manner, in combination with the washing procedure. Advantageously, liquor recovered from the process can be recycled for dilution purposes, for example, prior to the alkaline delignification stage. Similarly, liquor recovered from the process is advantageously recycled, for washing pulp after the activation stage and the alkaline delignification stage. Other internal recycling systems can also be used, irrespective of the washing system in general.

According to a preferred embodiment of the invention, sodium nitrate is recovered in an aqueous solution in a continuous-flow operation by washing the pulp in a manner such that at least 70%, suitably at least 80%, preferably at least 90%, of the washing water supplied to the system is charged to a liquor-recovery stage located downstream of the alkaline delignification stage in the direction of pulp movement, and the alkaline discharge from that stage preferably after being recycled within the alkaline delignification stage and/or the liquor-recovery stage is divided into several streams. One stream comprising at least 40%, suitably at least 50%, preferably at least 70%, of the total outflow is used for washing the acid spent liquor from the activation stage. This is carried out in a liquor-recovery stage located between the activation stage and the alkaline delignification stage. Another stream by-passes the activation stage and the last mentioned liquor recovery stage, and is supplied directly for washing the pulp from the cooking stage prior to the activation stage. This stream is primarily used to displace spent cooking liquor, and is preferably brought into contact with the pulp before the outflow from the liquor-recovery stage located downstream of the activation stage is brought into contact with the pulp.

It is particularly suitable with respect to the final bleaching of the pulp and to the recovery of sodium to remove alkali from the pulp before the delignified pulp leaves the system. This can be achieved by transferring a stream of spent liquor washed out from the activation stage, and using this partial stream for washing the pulp in the liquor-recovery stage located downstream of the alkaline delignification stage.

In order to remove any lignin remaining in the pulp, subsequent to treating the pulp in accordance with the process of the invention, the pulp is suitably treated in accordance with known final bleaching techniques, for example, by use of one or more of the usual bleaching agents: peroxide, chlorine dioxide, hypochlorite and optionally chlorine.

After the activation stage, the pulp is washed, suitably with water and/or an aqueous solution obtained from cellulose manufacturing processes or from, for example, processes integrated with said cellulose manufacture, such as paper production. If the washing is omitted, the consumption of alkaline neutralization medium in the following alkaline delignification stage is greatly increased. Instead of water, or particularly after a water wash, it is advantageous to treat the pulp with an alkaline-reacting solution, for example, bleaching liquor.

In accordance with a preferred embodiment, the cellulose pulp after the activation stage is washed with water and/or an aqueous solution under such conditions that an acid solution results, which can be used to wash pulp after cooking, preferably after displacing cooking liquor with liquor from some oxygen bleaching stage.

Whenever the pulp after the activation stage is washed with water or with an aqueous solution, so that an acid solution results, or a similar washing, it is desirable to subject the pulp to an alkaline extraction with an alkaline-reacting solution, suitably at from about 20° to about 100° C., preferably at from 40° to 80° C. As such solution there can be used waste liquor from oxygen gas bleaching, for example, from the oxygen gas stage of the present invention, either entirely or in part. In this way, a part of the modified lignin is extracted out of the activated pulp.

When only moderate delignification is desired, the alkaline delignification stage can comprise an alkali extraction. Hot alkali treatment under severe conditions results in a more extensive delignification, although at the cost of a significant loss of carbohydrates. Alkaline treatment with a peroxide addition can also be effected.

It is suitable that a part of the alkaline extracting liquor be recirculated for another alkaline extraction, or added for washing in another part of the system, for example, for displacement of cooking liquor from the pulp before the activation stage. A part of the liquor from the extraction stage can with advantage accompany the pulp to a subsequent alkaline oxygen gas bleaching stage.

Alkaline-oxygen gas bleaching is superior to other alkaline delignification stages with respect to delignification, pulp yield and chemical costs. Optionally, an alkaline oxygen gas bleaching stage can follow a hot alkali treatment stage and/or an alkaline treatment stage with an addition of peroxide. This enables the pulp to be extensively delignified without excessive loss of carbohydrates.

Either at the beginning and/or particularly before the oxygen gas bleaching stage, the pulp is impregnated with an alkaline reacting neutralization medium, and possibly other known additives, such as, for example, magnesium compounds, complexing agents, formaldehyde, and/or phenylene diamine.

Despite the fact that the oxygen gas bleaching waste liquor contains many organic compounds which form complexes with divalent or trivalent metal ions, such as calcium, magnesium, manganese, copper and iron, present in the system, it has been found suitable to introduce to the pulp one or more additional chelating or complexing agents for transition metals, such an aminopolyphosphonic acids, aminopolycarboxylic acids, or other complexing agents which are not produced in the process prior to and/or during the oxygen gas stage. The introduction of complexing agents in conjunction with the oxygen gas bleaching delignification stage is often carried out in a manner such that the complexing agent and the chelates or complex metal compounds formed thereby are present during the oxygen gas bleaching delignification. In the case of pulps studied hitherto it has been found more advantageous to use complexing agents which are not produced in the process in accordance with the method of the invention to remove any complexed transition metal compounds by filtration and/or washing, prior to the oxygen gas bleaching delignification stage. Even when these complex compounds are removed prior to the oxygen gas bleaching delignification stage, it may be justified to subsequently add thereto further complexing agents so that a suitable complexing agent concentration is present during the oxygen gas bleaching delignification stage.

Normally, the maximum effect of a small amount of complexing agent, for example 0.1 kg/ton of pulp, is obtained in the method according to the invention when the addition is made in a slightly acid medium during or after the activating stage, preferably after the major part of the waste liquor from the activating stage is removed from the pulp, and any metal complexes that are formed are separated from the pulp prior to the oxygen gas stage.

If the oxygen gas delignification is to be continued to a Kappa number below 6, it is often necessary to add a larger quantity of complexing agents, for example, an amount within the range from about 0.2 to about 1 kg/ton of pulp. Even larger amounts of complexing agents can be employed, provided they are inert to the process. Addition of complexing agents can also suitably be made at other stages in the process, preferably such that complexes of, for example, manganese, are separated from the pulp (including the accompanying liquor) before the pulp enters the oxygen gas reactor vessel, and so that only complexing agents containing ligands not bound to transition metals are present during the oxygen gas delignification stage.

The complexing agents should be supplied to the pulp in solution at a pH below 7.5, suitably below 6, and preferably within the range from about 1 to about 4. The complex-forming reactions can be allowed to proceed for a short period of time, for example, for one minute, although improved selectivity can often be observed when the time for the treatment is extended to, for example, from 30 to 90 minutes. When the treatment is started at a pH of from 1 to 4, it is advantageous to increase the pH to within the range from about 6 to about 9 after a short period, for example, a period which embraces 10% of the total complex-forming reaction time. The complexing process with complexing agents is suitably effected at a temperature within the range from about 20° to about 100° C., preferably from 20° to 60° C. When a low pH is used, for example, a pH of 1 to 3, the time and temperature must be so adjusted that no appreciable reduction in pulp viscosity is obtained.

At least one complexing agent should be added that provides manganese complexes which at a pH 9 have a stability constant which is at least 1000, preferably at least 10,000 times, greater than the corresponding stability constant for any magnesium complexes present.

Particularly advantageous results have been obtained when using complexing agents containing at least one and preferably three nitrogen atoms, and at least two and preferably five phosphonic acid groups. Suitable compounds have several nitrogen atoms, each of which is bound to two or three methylene groups. Aminomethylenephosphonic acids can be used to advantage. Particularly good results have been obtained when using diethylenetriamine pentamethylene phosphonic acids.

Other groups of complexing agents that can be used are those used in conventional oxygen gas bleaching delignification processes. For example, polyaminopolycarboxylic acids, such as ethylenediamine tetraacetic acid, and preferably diethylenetriamine pentaacetic acid, are quite satisfactory, particularly if the major part of the complexes formed with transition metals are removed prior to the oxygen gas bleaching delignification stage. The complexing agents can be added in the form of free acids or salts, for example, in the form of sodium salts, or magnesium salts.

It is normal procedure in conventional oxygen gas bleaching delignification processes to add magnesium compounds, in order to protect the carbohydrates from excessive degradation. Additions of magnesium compounds are also advantageous when carrying out the process according to the invention, although the activation and pretreatment of the pulp have a substantially greater protective effect. If the pretreatment process is effective, it is possible, without noticeable disadvantage, to omit magnesium compounds, at least when complexing agents are added, as described above.

Selectivity in the process of the present invention is greatly improved by the introduction of complexing agents.

The complexing agents which are added and the complexing agents formed in situ during the treatment of the cellulose pulp influence the process according to the invention in many different ways. Consequently, it has been impossible to establish those reactions which facilitate the extensive delignification of the pulp without seriously affecting the degradation of the cellulose.

While providing the advantages noted above, the complexing agents also have disadvantages, for example, the removal of manganese compounds, which are delignification catalysts, and which are also protectors against cellulose degradation, such as manganese hydroxide. That under certain conditions manganese compounds effectively protect carbohydrates against degradation in oxygen gas bleaching delignification processes is described by Manoucheri and Samuelson, *Svensk Papperstidning* 80 (1977), 381, and International Paper's Swedish patent application No. 76 01935-8.

Despite this, it has been found that the best selectivity in the process of the invention is obtained when the manganese content of the pulp is reduced from the usual amount of from 70 to 150 mg Mn per kg pulp to less than 4 mg per kg (measured in the oxygen gas bleached pulp). Under comparable treatment conditions, selectivity decreases as manganese content of the oxygen gas bleached pulp increases. From the results it cannot be said that the effect is directly proportional to the manganese content. However, when optimizing the process for different starting pulps, it has been found that a marked improvement in selectivity can be obtained when a large quantity of manganese is removed from the pulp at the earliest possible stage of the process.

It is known that formaldehyde reacts with peroxide formed during the oxygen gas bleaching delignification process, to form formate ions and hydrogen gas. This means that, in conventional oxygen gas bleaching delignification processes, reactions between peroxide and transition metal compounds which give rise to free radicals are suppressed. This decreases the depolymerization of the cellulose. Tests have shown that although these disturbing reactions are less apparent in the process of the invention, formaldehyde not only retards the degradation of the cellulose, but also the delignification, although the net result is an improved selectivity. Hence, addition of formaldehyde can be advantageous under certain conditions.

The greatest effect of formaldehyde, using an addition of 0.5%, based on the dry weight of the pulp, has been obtained when the addition is made prior to the oxygen gas bleaching delignification stage. Paraformaldehyde or other known products which produce formaldehyde can be used, as well as formaldehyde. Hydrogen gas is formed as a byproduct, and can be removed from the reactor vessel by, for example, converting the gas catalytically to water, in known manner.

If a pulp with a very low lignin content is desired, this can be achieved by repeating the process of the invention one, two, or more times. When the two-stage process according to the invention is represented by the shorthand code $NO_2+O_2$, such pulp is obtained with the double sequence $NO_2+O_2+NO_2+O_2$. Triple, quadruple and more repeats can be used, if necessary.

Oxygen gas bleaching delignification of the pulp can be carried out at a pulp consistency within the range from about 1 to about 40%, suitably from 8 to 35%, preferably from 27 to 34%.

The total alkali addition can be within the range from about 1 to about 10%, calculated as NaOH, and based on the weight of the pulp. It has been found particularly advantageous to use a low alkali addition in the oxygen gas bleaching delignification stage, for example, an addition in the order of 1.5 and at most 3% NaOH, and to return oxygen gas waste liquor to the oxygen gas stage.

Conveniently, a longer than normal treatment time is used for the oxygen gas bleaching delignification stage, for example, a time within the range from about 60 to about 500 minutes, suitably from 90 to 300 minutes, preferably from 90 to 180 minutes.

The treatment temperature in the oxygen gas bleaching delignification stage is within the range from about 70° to about 170° C., preferably from about 70° to about 150° C. When formaldehyde is added to the system, the preferred temperature is within the range from 115° to 130° C. Despite the fact that formaldehyde has been found to retard delignification during oxygen gas bleaching delignification according to the invention, the treatment time can be shortened somewhat by applying higher temperatures.

The process of the invention makes it possible to lower the Kappa number of the pulp considerably in the bleaching stage by using chemicals which are relatively inexpensive, and which give rise to waste liquors which can be rendered innocuous by burning, which need not be dumped. Combustion of these waste liquors can be integrated with the combustion of the cooking waste liquor, without providing special arrangements for ejecting chloride from the system. Thus, the invention provides a bleaching delignification process using primarily oxygen gas, which is an inexpensive and innocuous bleaching chemical. Since the amount of lignin which remains in the pulp after the treatment in accordance with the invention is low, the amount of chlorine-containing bleaching agent required for finally bleaching the pulp is much lower than in previously known bleaching methods. Consequently, the waste discharges from the pulp manufacturing plant are reduced.

As a starting material in the process of the invention, one can employ a chemical pulp which has been partially delignified with oxygen gas before the activating stage. Also, the cellulose pulps can be subjected to the process in accordance with the invention several times, for example, two or three times, particularly if one wishes to drive the delignification further without the addition of chlorine-containing bleaching agents.

A preferred embodiment of the method according to the invention is illustrated in the flow sheet of FIG. 1.

The cellulose pulp and accompanying pulping liquor produced in the digester 1 passes via the line 2*a* to the spent pulping liquor-recovery plant 3. The first liquor-recovery plant 3 is advantageously built integrally with the digester 1. The pulp passes via line 2*b* from the liquor-recovery plant 3 to the screens 4, where the spent pulping liquor is separated and the pulp washed, and then via line 2*c* to the second liquor-recovery plant 5, where substantially all of the remaining pulping liquor is removed, and the pulp washed. Here, the washed pulp is impregnated with sodium nitrate, and optionally also with nitric acid present in the liquor supplied via line 12. The pulp then proceeds via line *2d* to the activation reactor 6, to which nitrogen oxides and oxygen gas are supplied. The pulp is then passed via line *2e* to the spent activation liquor-recovery plant 7, and then via line *2f* to the alkaline-delignifying reactor 8, to which alkali, for example sodium hydroxide, and, in accordance with a preferred embodiment of the invention, oxygen-gas are supplied. The delignified pulp finally reaches the spent delignification liquor-recovery plant 9, via line *2g*.

A suitable liquid for transporting the pulp via lines *2a, 2b, 2c, 2d, 2e, 2f, 2g* from one stage to the next while washing the pulp in countercurrent flow is water, supplied through line 10, via the liquor-recovery plant 9. Liquor washed from the pulp is passed in countercurrent flow through the entire system back to activation stage 3. The liquor removed from the delignification liquor-recovery plant 9, normally slightly alkaline, is passed through the line 11 to the activation liquor-recovery plant 7, for washing from the pulp its content of spent acid liquor originating from the activation stage 6. The resultant liquor is passed through the line 12 to the second pulping liquor-recovery plant 5, where the liquor washes out substantially all spent cooking liquor present in the pulp. The liquor effluent is passed through the line 13 to the first pulping liquor-recovery plant 3, in which the liquor is used for washing spent cooking liquor from the pulp. The displaced wash liquor, which contains now mainly spent cooking liquor, is removed from the system through the line 14 and can be sent to a soda recovery boiler for chemicals recovery by evaporation and combustion.

Part of the liquor passed through the line 13 can be sent via line 15 to dilute the pulp suspension prior to the screens 4.

The two pulping liquor-recovery plants 3 and 5 can be replaced by a single plant, operating in accordance with the countercurrent flow principle, and the screens 4 can be placed at another location, for example, after the alkaline-delignification reactor 8.

According to a preferred embodiment of the invention, a given quantity of nitric acid is supplied to the system so as to be present during the activation stage 6. Normally, the intended amount of nitric acid is supplied to the pulp by the impregnation of the pulp in the pulping liquor-recovery stage 5, with the liquor supplied through the line 12. It may be necessary, however, to supply to the system a mineral acid other than nitric acid, particularly when small amounts of nitrogen oxides are charged. This mineral acid is suitably supplied to the pulp at the liquor-recovery stage 5, or in the line *2d* immediately prior to the activation reactor 6.

To maintain chemical balance, it is often advantageous to remove a stream of the liquor in line 11 via line 16 directly to the pulping liquor-recovery stage 5, in an amount sufficient to transport the pulp, at a location prior to the introduction via line 12 of the spent acid liquor from the activation liquor-recovery plant 7.

It is also possible to pass a stream of liquor from the line 11 directly to the first pulping liquor-recovery plant 3 via another line not shown in the figure.

The countercurrent flow-washing processs using pure water via line 10 as described above with some recycling of alkaline delignification liquor from stage 8 have the advantage that the energy consumed when evaporating the spent liquor taken out through line 14 can be kept low without releasing large quantities of organic substances to the atmosphere or the environment.

According to an alternative embodiment, which is not as economical with respect to energy, water is also supplied to the pulp at stage 7 through the line 17. A new plant for the purpose of applying the invention is suitably provided with both line 16 and line 17, since this increases the flexibility of the plant, particularly when starting-up the plant and when operating conditions change, for example, as a result of a change in the qualities required of the pulp, and changes in rules and regulations regarding care and protection of the environment. According to this alternative, it is possible to omit the transfer of alkaline waste liquor through the line 11 to the liquor-recovery stage 7, and use this spent liquor entirely for washing the pulp in the second pulping liquor-recovery stage 5 and/or in the first pulping liquor-recovery stage 3. Water or a dilute aqueous solution is then supplied to the pulp through the line 17, in a quantity sufficient for washing out a large part of the nitric acid formed during the activation process, this nitric acid then being passed to the liquor-recovery stage 5, through the line 12, to be returned to the process.

Another method of forming the desired amount of sodium nitrate in situ when activating the pulp, and, in accordance with a preferred embodiment of the invention, the desired amount of nitric acid, is to take some of the various spent liquors from the process, and remove inorganic ions or organic substances before the spent liquor is returned to the process. This removal can be effected by known membrane methods, such as dialysis, ultrafiltration and reverse osmosis, adsorption methods, ion-exchange methods, or by separation techniques based on ion-exchange membranes. Wet-combustion of waste liquors can also be applied, with or without preceding concentration, by evaportation or by separating out the water present as ice.

For the sake of simplicity, the internal circulation of liquors in various stages, with the intention of increasing the solid-substance content of the liquors, has not been shown in the figure.

Experiments in which the method according to the invention was applied have been carried out, and the results achieved are set forth in the following working Examples. These examples describe batchwise operation in laboratory apparatus, and simulating also continuous operation on a commercial scale. Batchwise operation in the laboratory normally provides a good indication of how the process would behave in a continuous apparatus on a large scale.

EXAMPLES 1 AND 2

Unbleached sulphate pulp manufactured from softwood, mainly pine, having a Kappa number of 34.3 and an intrinsic viscosity of 1197 $dm^3/kg$ was treated in accordance with the invention. The pulp was impregnated with aqueous 0.4M sodium nitrate solution, and pressed to a pulp consistency of 31%. The pulp was fluffed in a shredder, and fed into a rotary reactor, which was then evacuated and heated to 47° C.

The pulp was activated by adding 2% $NO_2$ gas, calculated on the dry weight of the pulp, the nitrogen dioxide being introduced in three portions over a period of five minutes, by gasifying liquid $N_2O_4$. Oxygen gas was then supplied in three portions, over a period of three minutes, so that the total pressure rose to 90% of atmospheric pressure. The reaction was interrupted after 60 minutes, by diluting the pulp and washing the same with water.

The activated pulp was then subjected to an alkaline oxygen-gas bleaching delignification at 105° C. and a pulp consistency of 12%, using an NaOH-charge of 10%, calculated on the original dry pulp. The oxygen-gas pressure was 0.15 MPa. Protector was added in the form of a magnesium complex with spent bleaching liquor, in an amount of 0.2% Mg, calculated on the dry weight of the pulp. The reaction time was 50 minutes in Example 1 and 100 minutes in Example 2.

In a similar manner, control runs A and B were carried out, in which the pulp was impregnated with water instead of sodium nitrate solution. In Controls C and D, the pulp was impregnated only with nitric acid, of the same molarity as the sodium nitrate solution used in Examples 1 and 2.

In all runs the viscosity and Kappa number of the pulps produced were determined in accordance with SCAN.

The run conditions and the results obtained are set forth in Table I.

TABLE I

| Example | Pulp impregnated with | Time in $O_2$-bleaching (Minutes) | After $O_2$-bleaching Kappa Number | After $O_2$-bleaching Viscosity $dm^3/kg$ |
|---|---|---|---|---|
| Example 1 | 0.4 M $NaNO_3$ | 50 | 14.7 | 1130 |
| Example 2 | 0.4 M $NaNO_3$ | 100 | 9.2 | 1025 |
| Control A | Water | 50 | 16.2 | 1102 |
| Control B | Water | 100 | 10.7 | 1025 |
| Control C | 0.4 M $HNO_3$ | 50 | 9.8 | 990 |
| Control D | 0.4 M $HNO_3$ | 100 | 8.2 | 915 |

As can be seen from Table I, an improved delignification was obtained by activation in the presence of sodium nitrate, this improvement being reflected in a lower Kappa number. This is surprising, since nitrate ions are extremely stable in dilute aqueous solutions. Despite the improved delignification, a high viscosity was obtained after the alkaline oxygen delignification stage. While delignification was better when the sodium nitrate was replaced with nitric acid, an increased depolymerisation of the pulp was obtained, reflected in the lower viscosity. The viscosity of the pulp after alkaline oxygen-gas bleaching for 100 minutes was beneath the limit normally considered acceptable for sulphatepaper pulps of conventional quality. The highest selectivity was obtained in the Examples in accordance with the invention.

EXAMPLES 3 TO 14

In these examples, an unbleached sulphate pulp produced from 90% softwood and 10% hardwood, mainly birch, was treated. The softwood comprised 70% pine and 30% spruce. The Kappa number of the pulp was 36.5, and its viscosity 1240 $dm^3/kg$.

In Examples 3 to 11 in accordance with the invention the pulp was impregnated with aqueous solutions prepared by dissolving sodium nitrate in nitric acid, so as to obtain the molarity given in Table II with respect to $NaNO_3$ and $HNO_3$.

In Examples 12 to 14 according to the invention, sodium nitrate in aqueous solution was used. The pulp consistency was 33%. The pulp was activated in the same manner as that in Examples 1 and 2, but the $NO_2$-charge was reduced to 1%.

The alkaline oxygen-gas bleaching delignification was carried out as in Examples 1 and 2. In order to obtain lower Kappa numbers, Examples were also carried out with a residence time in the alkaline oxygen-gas delignification stage of 200 minutes.

Control runs E to G were carried out in the same manner with pulp impregnated with water, while the pulp used in reference Control runs H to K was impregnated with 0.7M nitric acid.

The run conditions and the results obtained are set forth in Table II.

TABLE II

| Example | Pulp impregnated with | Time in $O_2$-bleaching (Minutes) | After $O_2$-bleaching Kappa Number | After $O_2$-bleaching Viscosity $dm^3/kg$ |
|---|---|---|---|---|
| Example 3 | 0.5 M $NaNO_3$ | 50 | 12.7 | 1090 |
| Example 4 | + 0.2 M $HNO_3$ | 100 | 10.6 | 1033 |
| Example 5 | | 200 | 8.7 | 982 |
| Example 6 | 0.35 M $NaNO_3$ | 50 | 12.4 | 1086 |
| Example 7 | + 0.35 M $HNO_3$ | 100 | 10.2 | 1052 |
| Example 8 | | 200 | 8.4 | 1013 |
| Example 9 | 0.7 M $NaNO_3$ | 50 | 10.2 | 1035 |
| Example 10 | + 0.7 M $HNO_3$ | 100 | 8.2 | 992 |
| Example 11 | | 200 | 6.8 | 960 |
| Example 12 | 0.7 M $NaNO_3$ | 50 | 16.6 | 1142 |
| Example 13 | | 100 | 14.3 | 1092 |
| Example 14 | | 200 | 10.9 | 1035 |
| Control E | Water | 50 | 19.9 | 1113 |
| Control F | | 100 | 16.8 | 1090 |
| Control G | | 200 | 15.1 | 1024 |
| Control H | 0.7 M $HNO_3$ | 50 | 11.5 | 1026 |
| Control I | | 100 | 9.8 | 1010 |
| Control K | | 200 | 8.2 | 972 |

The Examples 12 to 14 according to the invention, carried out with pulp which had been impregnated only with sodium nitrate show that delignification after the alkaline oxygen-gas bleaching delignification stage is more extensive than with a water-impregnated pulp, even with a nitrogen dioxide charge of only 1%, and that this advantage is obtained without any increases in the depolymerisation of the carbohydrates in the pulp, reflected in the viscosity values.

As can be seen from the Examples 3 to 5, the delignification obtained with a solution containing both an addition of sodium nitrate and nitric acid (0.5M $NaNO_3$+0.2M $HNO_3$) is more extensive than the delignification obtained after impregnating the pulp with a 0.7M $NaNO_3$-solution.

Examples 6 to 8 show that delignification was further improved under the conditions used, when the concentrations of sodium nitrate and nitric acid were changed to 0.35 g mole per kg of water of each. With extensive delignification in the oxygen-gas delignification stage, i.e., under conditions which are of the greatest significance with respect to economy and effect on the environment, this mixture gave a marked improvement with respect to selectivity in comparison with both waterimpregnated pulp and pulp impregnated solely with sodium nitrate of the same total molarity. The selectivity was also superior to that obtained with 0.7M $HNO_3$.

As can be seen from Examples 9 to 11, the lowest Kappa number after the oxygen-gas bleaching delignification stage was obtained with a solution which was 0.7 molar with respect to both added sodium nitrate addition and added nitric acid. The selectivity at low Kappa numbers thereby was higher than that achieved in the other test series. When compared with disclosures made in the earlier published material, it is surprising that a Kappa number below 7 can be obtained while maintaining a viscosity of above 950 $dm^3/kg$, while charging only 1% $NO_2$ to the system.

Having regard to the foregoing disclosure the following is claimed as the inventive and patentable embodiments thereof:

1. A process for delignifying bleaching lignin-containing cellulose pulp which comprises:

(1) activating cellulose pulp by reacting the pulp at a pulp consistency within the range from about 20% to about 60% and at a temperature within the range from about 20° to about 130° C. with a gas comprising $NO_2$ and oxygen in the presence of water, sodium nitrate in an amount of at least 0.15 g mole per kg of water, and nitric acid;

(2) washing the activated pulp with water or an aqueous solution; and (3) treating the activated washed pulp with an aqueous alkaline solution at a temperature within the range from about 70° to about 170° C., in the presence of oxygen gas, until the lignin content of the pulp is so reduced that the Kappa number of the pulp is within the range from about 10 to about 60% of the Kappa number of the pulp entering the activating stage (1).

2. A process according to claim 1, in which the sodium nitrate is added to the cellulose pulp before adding $NO_2$ thereto.

3. A process according to claim 1, in which the delignified pulp from stage (3) is diluted with water and the resulting aqueous solution withdrawn and sodium nitrate therein recycled to stage (1).

4. A process according to claim 1, in which aqueous solution from stage (2) is withdrawn and sodium nitrate therein recycled to stage (1).

5. A process according to claim 1 in which in stage (1) the sodium nitrate is in the form of an aqueous solution, and said aqueous solution is withdrawn and sodium nitrate therein recycled to stage (1)

6. A process according to claim 1, in which nitric acid is present in at least part of stage (1) in an amount within the range from 0.05 to 1.2 g mole per kg of water.

7. A process according to claim 1, in which sodium nitrate from the activation stage is recovered in aqueous solution by washing acidic spent activation liquor from the pulp with an aqueous solution after the activation stage; passing at least 70% of the resulting aqueous washing solution to a liquor-recovery stage downstream of the alkaline delignifying stage; and recycling alkaline effuent from said stage for washing the pulp after the activation stage.

8. A process according to claim 7, in which a stream of spent liquor washed out in the activation stage is passed to the liquor-recovery stage downstream of the alkaline delignification stage, and used for washing in said stage.

9. A process according to claim 1, in which the moisture content of the pulp introduced in the activation stage, the temperature during said stage, and the amount of sodium nitrate, nitric acid, nitrogen oxides and oxygen gas charged thereto are so adjusted that, when half the activation time has passed, the amount of $NO+NO_2$ in the gas phase is at least 0.08 m moles per liter.

10. A process according to claim 9 in which the temperature during stage (3) is within the range from about 90° to about 135° C.

11. A process according to claim 9, in which the temperature during stage (3) is within the range from about 100° to about 115° C.

12. A process according to claim 1, in which stage (3) comprises an alkaline oxygen-gas bleaching stage.

13. A process according to claim 1 in which the nitric acid content of the pulp prior to stage (1), the amount of nitrogen oxides, the pulp consistency, the temperature, and the residence time in stage (1) are so controlled that the intrinsic viscosity of the pulp at the end of stage (1) is from 2 to 35% less than at the beginning of stage (1).

14. A process according to claim 1 in which magnesium is present during the alkaline treatment stage (3) in an amount to reduce depolymerization of the carbohydrates.

15. A process according to claim 1 in which manganese is present during the alkaline treatment stage (3) in an amount to reduce depolymerization of the carbohydrates.

16. A process according to claim 1 in which the cellulose pulp is a chemical cellulose pulp prepared using an alkaline pulping liquor selected from the group consisting of sulfate pulp, polysulfide pulp, and soda pulp.

* * * * *